US008414710B2

(12) United States Patent
Minemura et al.

(10) Patent No.: US 8,414,710 B2
(45) Date of Patent: Apr. 9, 2013

(54) METHOD FOR SURFACE TREATMENT OF METAL MATERIAL

(75) Inventors: Kazuo Minemura, Haga-gun (JP); Sakae Abe, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/587,275

(22) PCT Filed: Feb. 2, 2005

(86) PCT No.: PCT/JP2005/001862

§ 371 (c)(1),
(2), (4) Date: Jul. 25, 2006

(87) PCT Pub. No.: WO2005/075705

PCT Pub. Date: Aug. 18, 2005

(65) Prior Publication Data

US 2007/0157997 A1 Jul. 12, 2007

(30) Foreign Application Priority Data

Feb. 4, 2004 (JP) ..... 2004-027475
Feb. 9, 2004 (JP) ..... 2004-032120

(51) Int. Cl.
*C23C 8/80* (2006.01)
*C23C 8/24* (2006.01)
*C23C 8/06* (2006.01)

(52) U.S. Cl.
USPC ..... 148/206; 148/218

(58) Field of Classification Search ..... 148/206, 148/218
See application file for complete search history.

(56) References Cited

U.S. PATENT DOCUMENTS

| | | | | |
|---|---|---|---|---|
| 2,904,875 | A * | 9/1959 | Trigg et al. | 29/609 |
| 4,328,044 | A | 5/1982 | Chasteen | |
| 4,504,324 | A * | 3/1985 | Furuno | 148/255 |

FOREIGN PATENT DOCUMENTS

| | | |
|---|---|---|
| DE | 296 967 B5 | 12/1991 |
| JP | 45-025966 | 8/1970 |
| JP | 47-034133 | 11/1972 |
| JP | 56-128670 | 10/1981 |
| JP | 59-035672 | 2/1984 |
| JP | 61-110758 | 5/1986 |
| JP | 01-165755 | 6/1989 |
| JP | 01-503790 | 12/1989 |
| JP | 02-025560 | 1/1990 |
| JP | 02-122062 | 5/1990 |
| JP | 05-202464 | 8/1993 |
| JP | 5-263278 | 10/1993 |
| JP | 7-054123 | 2/1995 |
| JP | 08-104972 | 4/1996 |
| JP | 9-071853 | 3/1997 |
| JP | 10-018017 | 1/1998 |
| JP | 2004-091892 | 3/2004 |

OTHER PUBLICATIONS

Gredelj, S., Gerson A., Kumar, S., Cavallaro, G., Jan. 31, 2001, Applied Surface Science 174 (2001) pp. 240-250.*
Japanese Office Action dated Oct. 6, 2009 for Application No. 2005-026203.
Japanese Office Action dated Oct. 6, 2009 for Application No. 2005-026210.

* cited by examiner

*Primary Examiner* — Jessee R. Roe
(74) *Attorney, Agent, or Firm* — Squire Sanders (US) LLP

(57) ABSTRACT

A method for a surface treatment of a metal material, which comprises subjecting a metal material such as an Fe alloy, a Ni alloy and an Al alloy to a heat treatment in the presence of an amino-based resin such as a melamine-formaldehyde resin. The amino-based resin can be caused to be present with the metal material by a method wherein the resin is applied on the surface of the metal material, directly or via a solvent such as water, or wherein the amino-based resin is placed in a container, and the container and the metal material are placed in a heat treatment furnace. The above heat treatment allows a passivated film to disappear from the metal material. Further, a subsequent elevation of temperature and the supply a nitriding gas allows the performance of a nitriding treatment being several times more effective than a conventional treatment, and a subsequent supply of a carburizing agent allows the performance of a carburizing treatment.

5 Claims, 4 Drawing Sheets

FIG. 5

| | MEMBER | MATERIAL | THICKNESS OF COMPOUND LAYER OR NITRIDE LAYER (TIMES) | SURFACE HARDNESS (TIMES) | DEPTH OF DIFFUSION LAYER (TIMES) |
|---|---|---|---|---|---|
| GAS NITROCARBURIZING (600°C × 2hr) | CRANK SHAFT | S40C | 1.6 | 1.2 | 1.4 |
| | ENGINE VALVE | NCF3015 | 7.5 | 1.6 | - |
| | | NCF6018 | 5 | 1.9 | - |
| | | NCF440 | 2 | 1.6 | - |
| | | SKH51 | 1.1 | 1.1 | - |
| | | SUH11 | 2 | 1.2 | - |

METHOD FOR SURFACE TREATMENT OF METAL MATERIAL

TECHNICAL FIELD

The present invention relates to a surface treatment method to be applied to a surface of a metal material.

BACKGROUND ART

It is desired that a sliding-contact surface of a certain member, with which another certain member contacts slidingly, be excellent, for example, in the abrasion resistance, the toughness, and the strength. In order to improve various characteristics as described above, for example, it has been hitherto suggested that various surface treatments including the carburizing, the sulfurizing, the nitriding, and the carbonitriding are applied to a member composed of stainless steel. Any of the treatment methods is carried out while keeping the member at a high temperature.

A passive film composed of iron oxide, which is spontaneously generated by being oxidized by oxygen contained in the air, is present on the surface of the iron group alloy including stainless steel. For example, the passive film inhibits the progress of the nitriding process when the stainless steel is subjected to the nitriding treatment. As a result, the nitriding efficiency tends to be lowered.

In view of the above, the removal of the passive film is widely carried out before applying the nitriding treatment. The wet method has been hitherto adopted as the removing treatment, in which the stainless steel is immersed in an aqueous solution of cyanogen compound or the like. However, the cyanogen compound is toxic. Therefore, an inconvenience arises such that handling the compound is a burden on the operator, and a detoxifying mechanism is required to be installed. Further, the waste liquid after use needs to be treated by means of an appropriate method.

In order to avoid the inconvenience as described above, the so-called dry method such that the passive film is removed by means of the mechanical polishing, or the heat treatment is performed in a reaction gas atmosphere containing fluorine, is suggested in Japanese Laid-Open Patent Publication Nos. 5-263278 and 7-54123 respectively. However, in the case of the method described in Japanese Laid-Open Patent Publication No. 5-263278, it is difficult to allow a workpiece to have a desired shape. On the other hand, in the case of the method described in Japanese Laid-Open Patent Publication No. 7-54123, it is necessary to install a detoxifying mechanism, because the fluorine gas is a toxic material. Therefore, an inconvenience arises such that cost of facility and equipment is high. Further, it is hard to say that the working environment is safe, because the toxic material is used.

In view of the above, it is conceived that the hydrogen sputtering method, which is one type of the dry method, is adopted as suggested in Japanese Patent Publication No. 2-2945. In this procedure, a mixed gas composed of hydrogen gas and nitrogen gas is introduced into a treatment chamber to cause the glow discharge in which the treatment chamber is the anode, an auxiliary electrode is the cathode, and a workpiece is the neutral. The passive film is reduced and removed by hydrogen ion and ammonia ion generated thereby.

However, the method described in Japanese Patent Publication No. 2-2945 involves the following inconvenience. That is, the depths of permeation and diffusion of hydrogen ion and ammonia ion with respect to the workpiece are small in a certain type of steel material such as steel materials having high contents of Cr, Ni, or the like. For this reason, the passive film is insufficiently removed. Therefore, the compound layer, which is to be formed by the plasma nitriding process thereafter, may have nonuniform thicknesses, and some portions, at which no compound layer is formed, may disadvantageously be generated in some situations.

A general object of the present invention is to provide a surface treatment method for a metal material, which makes it possible to easily and conveniently remove a passive film on a surface of the metal material irrespective of the quality of the metal material and which can be carried out in a safe environment.

A principal object of the present invention is to provide a surface treatment method for a metal material, which makes it possible to continuously carry out various surface treatments such as the nitriding and the carburizing after removing a passive film.

Another object of the present invention is to provide a surface treatment method for a metal material, which makes it possible to improve hardnesses of various metal materials to deeper inside portions thereof and which can be carried out easily and conveniently in a safe environment.

DISCLOSURE OF THE INVENTION

According to one embodiment of the present invention, there is provided a surface treatment method for treating a surface of a metal material by heating the metal material, the surface treatment method comprising:

removing a passive film by heating the metal material in a place in which amino resin is present.

When the heat treatment is performed in the presence of the amino resin, the amino resin thermally decomposes to liberate C, N, H. HCN and NO, which are produced with the liberated C, N, H and O, attack the passive film. Accordingly, the passive film is finally eliminated. That is, according to the present invention, substantially all of the passive film, which exists on the surface of the metal material, can be easily removed by means of the extremely convenient operation in which the metal material is subjected to the heat treatment in the presence of the amino resin.

According to Material Safety Data Sheet, the amino resin has no toxicity. Therefore, the operation can be performed in a safe environment. The amount of production of HCN is slight, i.e., several thousands ppm. Further, HCN is immediately decomposed into nitrogen and carbon dioxide gas when the waste gas is combusted. Therefore, it is not especially necessary to provide any detoxifying equipment.

The removal of the passive film also proceeds during the temperature-raising process in which the temperature is raised to a temperature at which the nitriding treatment and/or the carburizing treatment is performed. That is, according to the present invention, the passive film can be eliminated during the temperature-raising process to be performed when various surface treatments, such as the nitriding treatment or the carburizing treatment, are carried out. Therefore, it is not necessary to perform any temperature-maintaining process in order to remove the passive film. Accordingly, the efficiencies of various surface treatments are not lowered when the passive film is removed.

The amino resin thermally decomposes to change into the gas phase, which exists as the atmospheric gas around the metal material.

The amino resin may be applied, for example, to the surface of the metal material. When the surface treatment such as the nitriding treatment or the carburizing treatment is applied thereafter, it is possible to quickly obtain various types of metal materials having the hardened layer with high hardness and large thickness as compared with any metal material to which the surface treatment is applied in a place in which the amino resin is absent. That is, it is possible to remove the passive film easily, conveniently, and quickly.

In this procedure, it is preferable that the amino resin is applied to the surface of the metal material by a solvent, for the following reason. That is, any uneven application is scarcely caused thereby. Therefore, it is possible to remove the passive film substantially uniformly.

It is also preferable that the amino resin is placed in a heat treatment furnace together with the metal material to heat the metal material, in place of the application. Also in this procedure, the passive film can be removed easily and conveniently in the safe working environment.

The term "amino resin" herein refers to the resin obtained by polycondensation of amino group and formaldehyde. Representative examples thereof may include melamine resin, urea resin, aniline resin, and formalin resin.

On the other hand, preferred examples of the metal material to which the surface treatment is applied may include Fe alloy, Ni alloy, Al alloy, Cu alloy, and Zn alloy.

In the present invention, the passive film is removed as described above, and then the surface of the metal material may be subsequently modified by forming a hardened layer or a compound layer on the surface of the metal material. Alternatively, a hardened layer or a compound layer may be formed on the surface of the metal material simultaneously with the removal of the passive film.

In the case of the metal material to which the heat treatment is applied in the presence of the amino resin, the hardness is improved as compared with any metal material to which the heat treatment is applied under a condition in which the amino resin is absent. Further, the region, in which the hardness is improved, ranges to deeper inside. In the present invention, it is enough that the heat treatment is applied in the presence of the amino resin. It is not especially necessary to strictly control the type and the ratio of the gas to be used, the reaction temperature, the reaction time or the like. According to the present invention, it is possible to improve the hardnesses of various types of metal materials.

As described above, according to the present invention, the convenient and easy operation is performed such that the heat treatment is performed in the presence of the amino resin, and thus the hardness is improved as compared with any metal material to which the heat treatment is applied under a condition in which the amino resin is absent. Further, the region, in which the hardness is improved, ranges to deeper inside.

The metal material, which is excellent in the hardness, is excellent in the abrasion resistance and the strength. That is, according to the surface treatment method for the metal material of the present invention, it is possible to obtain the metal material which is hardly abraded and which has high strength.

The modifying treatment may be, for example, the nitriding treatment. In this procedure, it is appropriate that the ammonia gas or the RX gas is allowed to flow during the heat treatment.

Alternatively, it is also appropriate that any carburizing gas is allowed to flow during the heat treatment. In this procedure, it is possible to apply a carburizing treatment to the metal material.

BRIEF DESCRIPTION OF THE DRAWINGS

FIG. 5 is a table showing materials of a crank shaft and engine valves, the thickness of the compound layer or the nitride layer, the surface hardness, and the diffusion layer depth after applying the gas nitrocarburizing treatment in the presence of melamine resin, as compared with a case in which the gas nitrocarburizing treatment is applied under a condition in which melamine resin is absent.

BEST MODE FOR CARRYING OUT THE INVENTION

Figure 1:
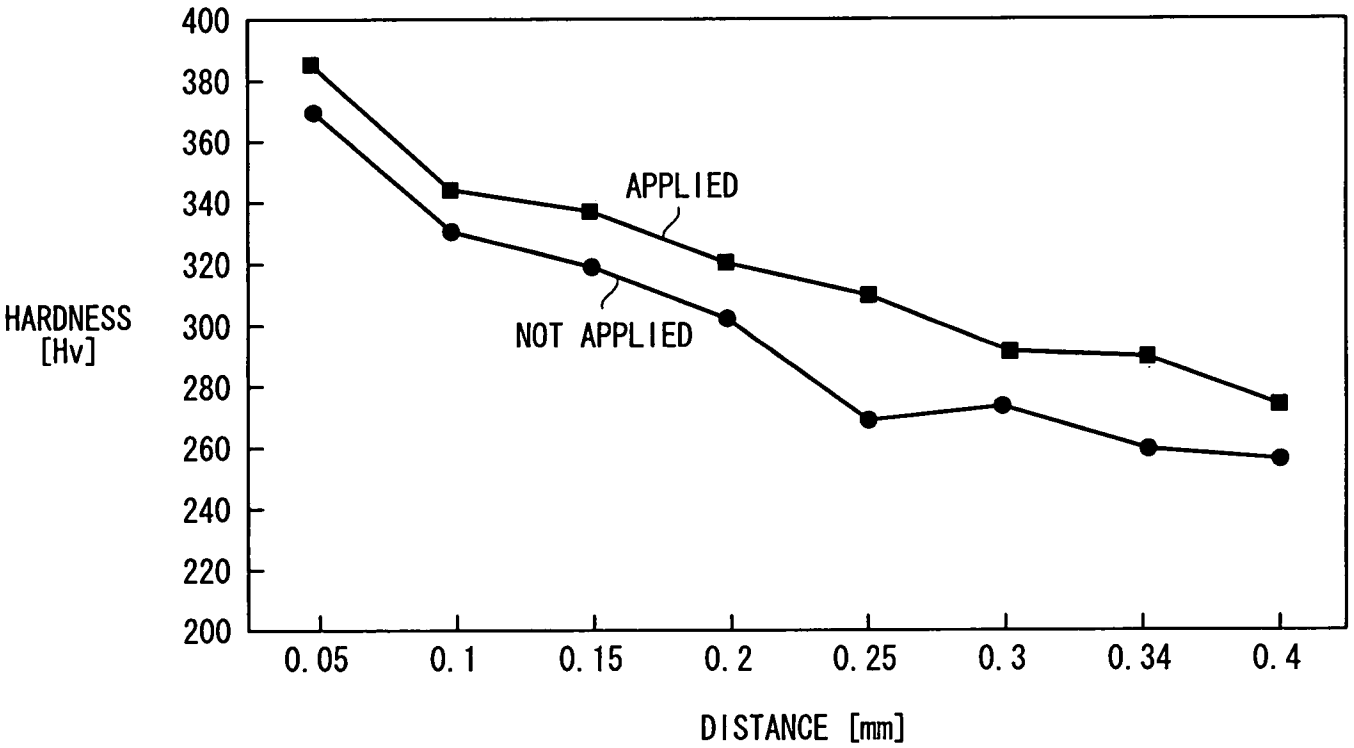
FIG. 1 is a graph showing the relationship between a distance from the surface and the Vickers hardness for a steel material in which the passive film is removed and the nitriding treatment is applied and a steel material in which the ordinary nitriding treatment is applied.

A surface treatment method for a metal material according to the present invention will be explained in detail below with reference to the accompanying drawings, as exemplified by preferred embodiments.

A surface treatment method according to an embodiment of the present invention comprises a first step of applying amino resin to the surface of the metal material, and a second step of heat-treating the metal material to which the amino resin has been applied. At first, an explanation will be made as exemplified by a case in which the gas nitrocarburizing treatment is performed for the metal material with a mixed gas of ammonia gas and RX gas.

Firstly, a member having a passive film composed of oxide on the surface thereof is selected as the metal material. Usually, a passive film is spontaneously generated by oxidation of the metal material with oxygen contained in the air.

Such a metal material includes a member composed of Fe alloy or Ni alloy. The member composed of Fe alloy is not specifically limited. However, the member composed of Fe alloy includes, a member made of cast iron and a member made of steel materials containing Cr, more specifically the crank shaft of the internal combustion engine of the automobile, as preferred examples. The member composed of Ni alloy is not specifically limited as well. However, the member of composed of Ni alloy may be exemplified by the engine valve composed of so-called super alloy which is expressed as 30Ni15Cr material. Also, 75Ni15Cr material may be used.

On the other hand, the amino resin refers to the resin obtained by polycondensation of amino group (—$NH_2$) and formaldehyde. Representative examples thereof include melamine resin represented by the following structural formula (1), urea resin represented by the structural formula (3), aniline resin represented by the structural formula (2), and formalin resin. The amino resin as described above is commercially available in a form of solid or powder.

Structural formula (1):

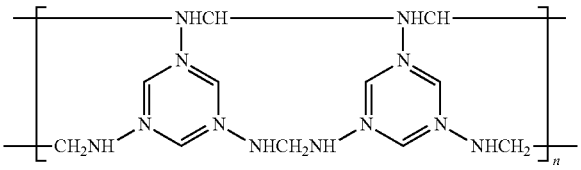

Structural formula (2):

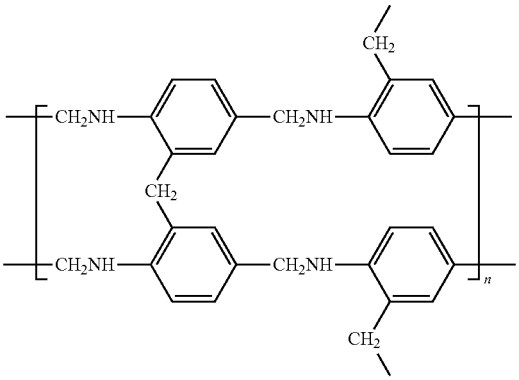

Structural formula (3):

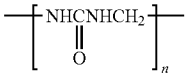

Representative examples include melamine formalin resin having the composition formula represented by $(C_6H_3N_9)_n$.

In the first step, the powder of the amino resin as described above may be directly applied to the surface of the metal material. Further, it is preferable that the powder is dispersed in a solvent such as water to prepare a suspension, and the suspension is applied, for the following reason. That is, in this way, it is possible to avoid the occurrence of uneven application. Consequently, the thickness of the compound layer to be formed can be made substantially uniform.

The application may be performed by means of the brush coating method using a brush. Also, any known coating technique other than the brush coating method may be adopted.

Subsequently, the metal material, to which the amino resin has been applied directly, or preferably applied by the suspension, is heat-treated in a heat treatment furnace in the second step. Specifically, the temperature of the heat treatment furnace may be raised after placing the metal material in the heat treatment furnace.

The amino resin begins to decompose during the process in which the temperature of the heat treatment furnace is raised. Accordingly, C, N, H, which are contained in the amino resin, are liberated, and HCN is formed by the liberated C, N, H. When O is incorporated, NO is further produced. The passive film is removed by being attacked by HCN or NO, and the passive film is finally removed. The amount of production of HCN is about several thousands ppm. Further, HCN is combusted in accordance with the heat treatment for the metal material. Therefore, it is not especially necessary to provide any detoxifying equipment.

As described above, according to the embodiment of the present invention, substantially all of the passive film on the surface of the metal material can be easily removed by means of the extremely convenient operation in which the amino resin is applied to the metal material, and then the metal material is heat-treated. Further, it is possible to use the existing equipment such as the heat treatment furnace. Therefore, it is not necessary to make any special investment in facility and equipment.

Further, the operation can be performed in a safe environment, because the amino resin has no toxicity.

During this process, the decomposed amino resin finally changes into the gas phase, which exists as the atmospheric gas in the heat treatment furnace.

In this embodiment, the nitriding treatment is performed for the metal material following the treatment for removing the passive film. That is, the temperature-raising process is continued to reach a predetermined temperature, and the temperature is maintained for a certain period of time, while allowing a mixed gas of ammonia gas and RX gas to flow. The temperature and the maintaining time depend on the type of the metal material. However, for example, the temperature may be maintained at 600° C. for 2.5 hours. During this heat treatment, the exposed surface of the metal material is nitrided by N liberated from the amino resin and N of the ammonia gas. During this procedure, it is unnecessary for N to pass through the passive film, because the passive film has already been removed. Therefore, it is possible to shorten the period of time required for the nitriding treatment, and it is possible to reduce the thermal energy.

Further, since the passive film is removed during the temperature-raising process for performing the nitriding treatment, it is also unnecessary to perform any special heat treatment process which would be otherwise performed such that a constant temperature is maintained in order to remove the passive film. Therefore, the efficiency of the nitriding treatment is not lowered by the removal of the passive film by the amino resin.

N is permeated and diffused from the surface into the inside of the metal material, and thus the compound layer is formed. The thickness of the compound layer, in other words, the distance of diffusion of nitrogen in the metal material, is extremely large as compared with a case in which the gas nitrocarburizing treatment is performed under the same condition except for the absence of the amino resin. That is, when the passive film is removed in the presence of the amino resin, and the nitriding treatment is applied thereafter, then it is possible to increase the thickness of the compound layer. As a result, the metal material can be hardened to deeper inside portions thereof.

Specifically, in the case of a crank shaft composed of S48C base steel, the compound layer, which is formed by an ordinary gas nitrocarburizing treatment, has a thickness of about 15 μm. On the contrary, according to the embodiment of the present invention based on the use of the melamine formalin resin, it is possible to provide a thickness of the compound layer of about 25 μm. That is, the crank shaft, which has high hardness to deeper inside portions, is obtained, as compared with the crank shaft to which the ordinary gas nitrocarburizing treatment is applied.

FIG. 1 shows the Vickers hardnesses measured in the direction from the surface to the inside for a steel material in which the ordinary gas nitrocarburizing treatment is applied and a steel material in which the gas nitrocarburizing treatment is applied after the melamine formalin resin is applied. The pressing load of the indenter is 300 g during the measurement. According to FIG. 1, it is clear that the hardness of the steel material and thus the metal material can be improved from the surface to the inside by applying the melamine resin.

In the embodiment of the present invention, when the metal material is an Fe alloy, it is recognized that fine martensite is produced, when the Fe alloy, which has been heat-treated, with an electron probe microanalyzer (EPMA).

Figure 2:
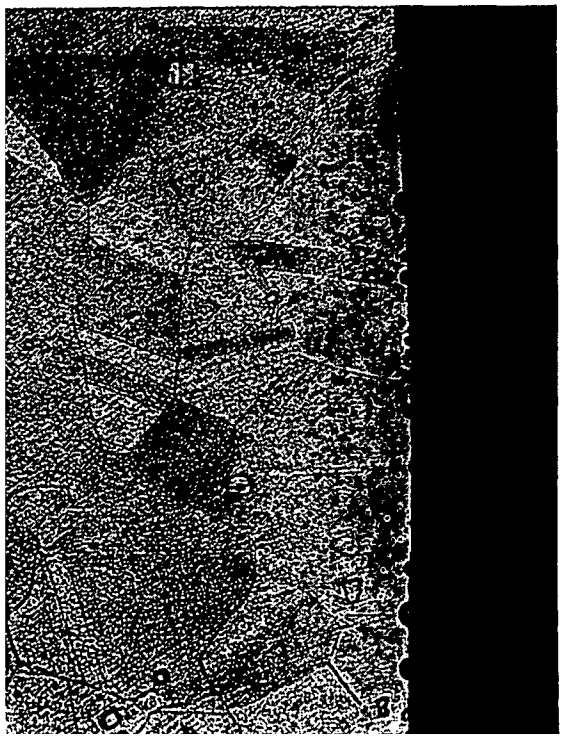
FIG. 2 is a microphotograph obtained with an optical microscope (magnification: ×400) of a cross section showing a compound layer at a surface layer portion of 30Ni15Cr material to which the gas nitrocarburizing treatment is applied in a state in which no amino resin is applied.
Figure 3:
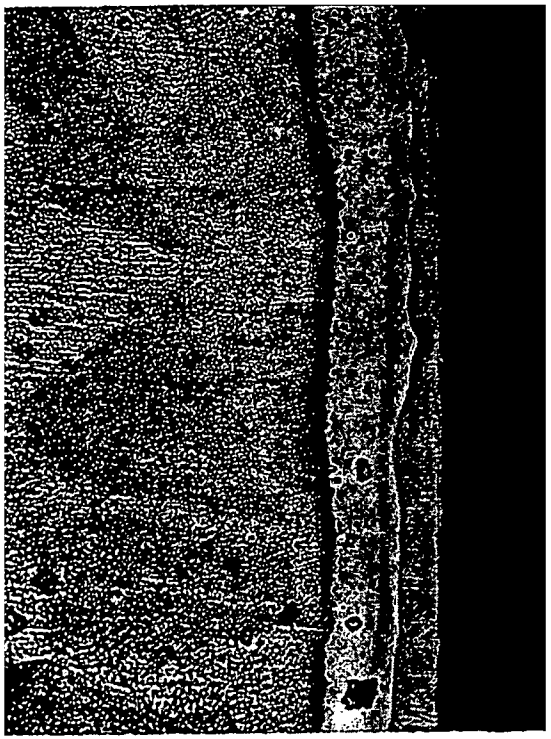
FIG. 3 is a microphotograph obtained with an optical microscope (magnification: ×400) showing a compound layer formed in 30Ni15Cr material by gas nitrocarburizing after removing the passive film.

With any technique other than the plasma nitriding treatment, it is difficult to apply the nitriding treatment to the surface of an engine valve composed of 30Ni15Cr material. For example, when the gas nitrocarburizing treatment is applied, then the compound layer is merely formed in a scattered form as shown in FIG. 2, and the thickness is about 3.75 μm at the maximum. However, according to the embodiment of the present invention in which the melamine formalin resin is used, the compound layer can be provided over the entire surface of the engine valve as shown in FIG. 3 by means of such an easy and convenient method that the heat treatment is performed at 600° C. for 2.5 hours while allowing the mixed gas of ammonia gas and RX gas to flow. Further, the thickness is about 37.5 μm which is about ten times the thickness obtained when the melamine formalin resin is not applied. Further, even in the case of a metal material for which it is difficult to apply the nitriding treatment, for example, in the case of 75Ni15Cr material, it is possible to obtain the compound layer having a thickness of about 5 μm by means of the heat treatment performed under the same condition.

As described above, according to the embodiment of the present invention, the heat treatment is performed after applying the amino resin to the surface of the metal material directly or by the solvent. Accordingly, substantially all of the passive film of the metal material can be removed easily and conveniently. Therefore, when the nitriding treatment is applied to the metal material, the degree of nitriding is substantially uniform. That is, it is possible to avoid the inconvenience which would be otherwise caused such that the thickness of the compound layer is nonuniform, and some portions, in which the compound layer is not formed, appear. Further, it is possible to obtain the metal material in which the thickness of the compound layer is large, and hence the hardness is high to deeper inside portions.

Further, in the embodiment of the present invention, it is not necessary to perform any preliminary treatment which would be otherwise performed, such that oxide film is removed with hydrofluoric acid or the like. Therefore, the operation can be advantageously performed in the safe environment.

Next, an explanation will be made about a surface treatment method according to a second embodiment, as exemplified by a case in which the carburization is performed by allowing a carburizing agent to flow after the passive film is removed.

In the second embodiment, at first, the same operation as that of the first step of the first embodiment is performed. That is, the amino resin is applied to the surface of the metal material.

Subsequently, a carburizing gas is allowed to flow, in place of the flow of the ammonia gas in the second step of the first embodiment. The carburizing gas may be the gas to be generally used for the gas carburization, such as propane gas, butane gas, RX gas, and so-called enriched gas.

When the carburizing treatment is performed, the heat treatment condition can be set, for example, such that the temperature is maintained at 920 to 950° C. for 1.5 hours. After that, the temperature may be maintained at 850° C. for 1 hour to perform the hardening treatment.

The carburization proceeds in accordance with the diffusion of carbon in the metal material. In particular, when the metal material is Fe alloy, the carburization proceeds quickly.

The metal material, to which the carburizing treatment is applied as described above, undergoes the increase in the distance of diffusion of carbon, in other words, the thickness of the effective hardened layer, as compared with a metal material to which the carburizing treatment is applied without applying the amino resin. Specifically, the thickness of the effective hardened layer is about 0.5 mm in the metal material subjected to the carburizing treatment without applying the amino resin. On the contrary, the thickness of the effective hardened layer is extremely large, i.e., about 1.6 mm in the metal material obtained by removing the passive film with the melamine formalin resin applied, followed by performing the carburization.

Figure 4:
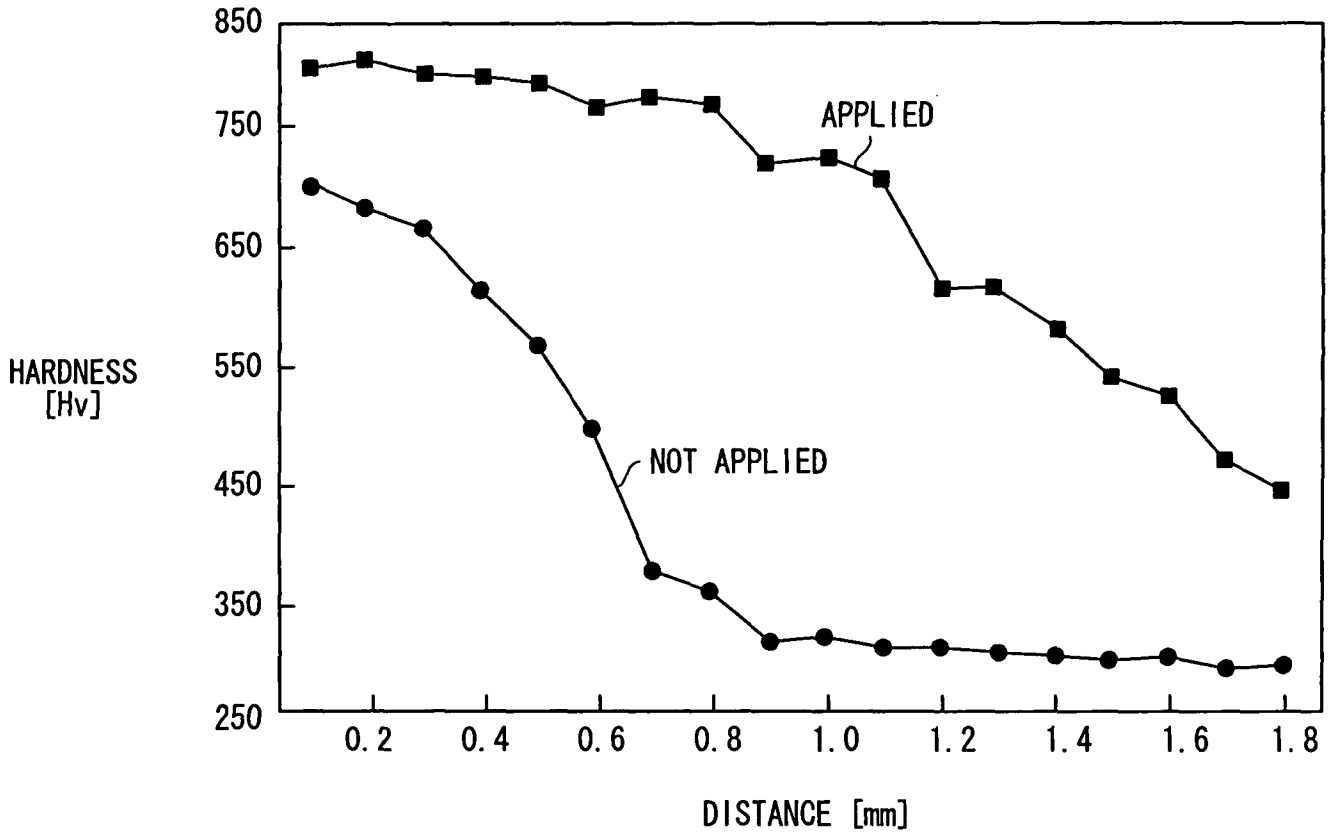
FIG. 4 is a graph showing the relationship between a distance from the surface and the Vickers hardness for a steel material in which the passive film is removed and the carburizing treatment is applied and a steel material in which the ordinary carburizing treatment is applied.

FIG. 4 shows the Vickers hardnesses measured in the direction from the surface to the inside for the steel material in which the carburizing treatment is applied without applying the amino resin and the steel material in which the carburizing treatment is applied after the melamine formalin resin is applied. The pressing load of the indenter is 300 g during the measurement in the same manner as described above. According to FIG. 4, it is clearly understood that the hardness of the steel material can be remarkably improved from the surface to the inside in the case of the carburizing treatment with the melamine resin applied, as well.

When the EPMA observation is performed for the steel material subjected to the carburizing treatment, it is recognized that N exists over the entire region of the effective hardened layer, i.e., carbonitride is produced, and fine martensite is produced.

Alternatively, the amino resin may be placed in a vessel, and the vessel may be introduced into the heat treatment furnace together with the metal material, in place of the application of the amino resin to the surface of the metal material. That is, in the present invention, it is enough that the amino resin exists in the heat treatment furnace during the heat treatment. It is not necessary to apply the amino resin to the surface of the metal material.

When the amino resin is placed in the heat treatment furnace, it is appropriate that the amount of the amino resin is about 1 to 10% per 1 kg of the metal material. For example, when the metal material is 10 kg, it is appropriate that 1 to 10%/kg of the amino resin is placed in the vessel and arranged in the heat treatment furnace.

Specifically, when the metal material is an engine valve composed of 75Ni15Cr material, then the melamine resin having an amount of 5% of the mass of the engine valve is introduced into the heat treatment furnace to raise the temperature, and then the temperature is maintained at 540° C. for 2 hours to apply the plasma nitriding treatment. As a result, it is possible to provide the compound layer having a thickness of about 5 μm.

The surface treatment, which is performed in the presence of the amino resin, is not limited to the nitriding treatment and the carburizing treatment, and other surface treatments may be performed. For example, an induction hardening treatment may be applied to the steel material after applying the amino resin to the surface of the steel material. The thickness of the effective hardened layer is about 9 mm in the case of the steel material to which the induction hardening treatment is applied in a state in which the amino resin is not applied. On the contrary, when the melamine formalin resin is applied to the surface of the steel material, the thickness of the effective hardened layer is about 11 mm which is larger than that of the case in which the melamine formalin resin is not applied. Alternatively, a sulfurizing treatment may be performed.

As described above, according to the embodiment of the present invention, the passive film can be removed easily and conveniently from the surfaces of various types of the metal materials. In any case, it is enough to apply the heat treatment in the presence of the amino resin. It is not necessary to strictly control the type of the gas to be used, the ratio thereof, the reaction temperature, the reaction time or the like.

Various types of the amino resins have no toxicity as clearly understood from Material Safety Data Sheet. Therefore, the operation can be carried out in the safe environment.

In the embodiment described above, various types of the surface treatments are applied after removing the passive film. However, the surface treatment may be performed while removing the passive film.

EXAMPLE 1

A crank shaft and engine valves were manufactured from metal materials shown in FIG. 5. The gas nitrocarburizing treatment was applied under a condition of 600° C. for 2 hours to the crank shaft and the engine valves in a state in which the melamine resin was placed in the heat treatment furnace. For the purpose of comparison, the gas nitrocarburizing treatment was performed under the same condition except that the melamine resin was not placed in the heat treatment furnace. FIG. 5 shows the thickness of the compound layer or the nitride layer and the surface hardness of the crank shaft and the engine valves, and the diffusion layer depth of the crank shaft to which the gas nitrocarburizing treatment was applied in the presence of the melamine resin, as the multiples with respect to those of the crank shaft and the engine valves to which the gas nitrocarburizing treatment was applied under the condition in which the melamine resin was absent. According to FIG. 5, it is clear that the thickness of the compound or the nitride and the surface hardness can be increased by performing the nitriding treatment in the presence of the melamine resin. This means that the passive film is easily removed, and the hardnesses of various types of the metal materials can be improved to deeper inside portions when the heat treatment is performed in the presence of the melamine resin.

INDUSTRIAL APPLICABILITY

According to the present invention, a heat treatment is applied to a metal material in a place in which the amino resin is present. When the convenient operation is performed as described above, a passive film, which exists on the surfaces of various types of the metal materials, can be easily removed in a safe working environment. Therefore, for example, when a nitriding treatment is performed simultaneously or thereafter, a compound layer having a substantially uniform thickness can be formed on the substantially entire surface of the metal material.

The invention claimed is:

1. A surface treatment method for removing a passive film on a surface of a metal material, said surface treatment method comprising:

raising the temperature of said metal material to a temperature at which the surface treatment is performed in a place in which amino resin is present, and during the raising of the temperature, removing the passive film by C, N and H which are liberated from the amino resin, wherein said surface of said metal material is modified by forming a hardened layer or a compound layer on said surface of said metal material subsequently to removing the passive film, performing a nitriding treatment, which comprises a combination of ammonia gas and an endothermic gas (RX gas), or a carburizing treatment after the removing of the passive film, wherein the performing of the nitriding treatment comprises applying the combination of the ammonia gas and the RX gas at a first predetermined temperature for a first predetermined period of time, and the performing of the carburizing treatment comprises applying a carburizing gas at a second predetermined temperature for a second predetermined period of time.

2. The surface treatment method according to claim 1, wherein said amino resin is applied to said surface of said metal material prior to heating said metal material.

3. The surface treatment method according to claim 2, wherein said amino resin is applied to said surface of said metal material by a solvent.

4. The surface treatment method according to claim 1, wherein said amino resin is not applied to said surface of said metal material and wherein said amino resin is placed in a heat treatment furnace together with said metal material to heat said metal material.

5. The surface treatment method according to claim 1, wherein melamine resin, urea resin, aniline resin, or formalin resin is used as said amino resin.

* * * * *

UNITED STATES PATENT AND TRADEMARK OFFICE

CERTIFICATE OF CORRECTION

PATENT NO. : 8,414,710 B2
APPLICATION NO. : 10/587275
DATED : April 9, 2013
INVENTOR(S) : Kazuo Minemura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 949 days.

Signed and Sealed this
Eighteenth Day of June, 2013

Teresa Stanek Rea
*Acting Director of the United States Patent and Trademark Office*